United States Patent [19]

Ritter

[11] 4,413,851

[45] Nov. 8, 1983

[54] RETAINER STRAP FOR GARBAGE CAN LID

[76] Inventor: Herbert W. Ritter, 13677 Torrey Pines Dr., Auburn, Calif. 95603

[21] Appl. No.: 267,366

[22] Filed: May 26, 1981

[51] Int. Cl.[3] ..... E05C 19/18

[52] U.S. Cl. ..... 292/259

[58] Field of Search ..... 292/259, 262, 288; 220/314, 326, 327, 1 T

[56] References Cited

U.S. PATENT DOCUMENTS

| | | | |
|---|---|---|---|
| 1,207,974 | 12/1916 | Miller | 292/288 |
| 2,108,521 | 2/1938 | Bell | 292/288 X |
| 2,404,124 | 7/1946 | Des Roches | 292/259 |
| 2,998,276 | 8/1961 | Shettler | 292/288 |

*Primary Examiner*—Richard E. Moore

*Attorney, Agent, or Firm*—Harrington A. Lackey

[57] ABSTRACT

A retainer strap for holding in closed position a lid, preferably having a top handle, upon a container, such as refuse or garbage can, having opposed open-loop side handles. One end portion of the strap is folded back upon itself and slidably retained by a buckle member to form an adjustable first loop extending through one of the open-loop side handles, while the opposite end of the strap extends through the opposite side handle and is folded back upon itself and retained in a fixed second loop by a pair of detachable snap fasteners. The middle portion of the strap either extends through or over the top handle of the lid, and the buckle member is adjusted to tighten the strap in operative position against the lid to hold the lid in closed position upon the container.

4 Claims, 5 Drawing Figures

RETAINER STRAP FOR GARBAGE CAN LID

BACKGROUND OF THE INVENTION

This invention relates to a closure retaining device, and more particularly to a retainer strap for a garbage or refuse can lid.

Garbage cans, when located outdoors, have always been vulnerable to the wind, the neighborhood dogs, and careless garbage men. Although the lids of garbage cans are constructed to fit snugly over the openings of the can, nevertheless they frequently become easily separated from the cans, particularly when the cans are knocked over, such as by the wind and by dogs seeking additional nourishment from the interior of the garbage cans.

Attempts have been made to retain the lids upon the garbage cans in such adverse conditions by providing garbage can retainer devices or straps of various types. Some of these prior lid retainer devices are disclosed in the following U.S. Pat. Nos.:

2,998,276, Shettler, Aug. 29, 1961
3,124,381, Geldart, Mar. 10, 1964
3,589,760, Williams, June 29, 1971
3,893,725, Coulter et al., July 8, 1975
3,980,202, Monyak et al., Sept. 14, 1976

Although the above Shettler U.S. Pat. No. 2,998,276 discloses an elongated flexible strap member having its opposite ends folded back upon themselves to form loops at opposite ends of the strap, and even though one of these loops is secured to an adjusting device for adjusting the length of the loops, nevertheless such loops are permanently fastened upon each of a pair of hook members which detachably engage the opposite side handles of the refuse can.

In practically all of the above U.S. patents, the lid retainer devices include an excessive amount of hardware, and none of them disclose a lid retainer strap in which loops are formed in both ends of the strap and both loops extend through and engage the side handles of the garbage can.

SUMMARY OF THE INVENTION

It is therefore an object of this invention to provide an improved retainer device for securing the lid in closed position upon a receptacle, such as a garbage can, having a pair of opposed open-loop side handles.

Furthermore, it is an object of this invention to provide a retainer strap for a garbage can lid utilizing a minimum of hardware, and in which open loops are formed at both ends of the strap for securely engaging and extending through the open-loop side handles.

Another object of this invention is to provide a garbage can lid retainer strap in which loops are formed at both ends of the strap for engaging the side handles, one loop being more or less permanently secured by one handle, yet being adjustable in size, while the other loop is readily detachable to facilitate engagement and removal of the strap from the other side handle.

More specifically, the retainer strap made in accordance with this invention comprises a single elongated strap member having one end looped upon itself and fastened to a slide buckle member to permit ready adjustment of the size of the loop as well as to tighten and loosen the strap upon the lid of the garbage can, when the loop is extended through and engages one of the open-loop side handles of the can. The opposite end of the strap member is folded back upon itself and secured in a fixed, but detachable, position extending through and secured to the other open-loop side handle, by means of a pair of detachable snap fasteners. The intermediate portion of the strap member extends through the opening in a conventional handle on top of the garbage can lid.

In refuse can lids having upward projecting solid handles with no open loops, a slit or slot may be formed through the middle portion of the strap member to fit over the top projecting lid handle.

By merely disengaging the snap fasteners, one loop end of the strap may be completely disengaged from one side handle of the can, while the other loop of the strap remains engaged with the other side handle, so the garbage can lid may be easily removed for the introduction of waste material into the garbage can or for discharge of the same. By merely replacing the lid in closed position and reconnecting the snap fasteners of the free end of the strap member after it has been extended through the side handle and folded back upon itself, the lid may be easily held in closed position. In order to tighten the strap upon the lid, the slide buckle member is merely adjusted along the length of the strap to shorten the overall length of the strap member.

DESCRIPTION OF THE PREFERRED EMBODIMENTS

Figure 1:
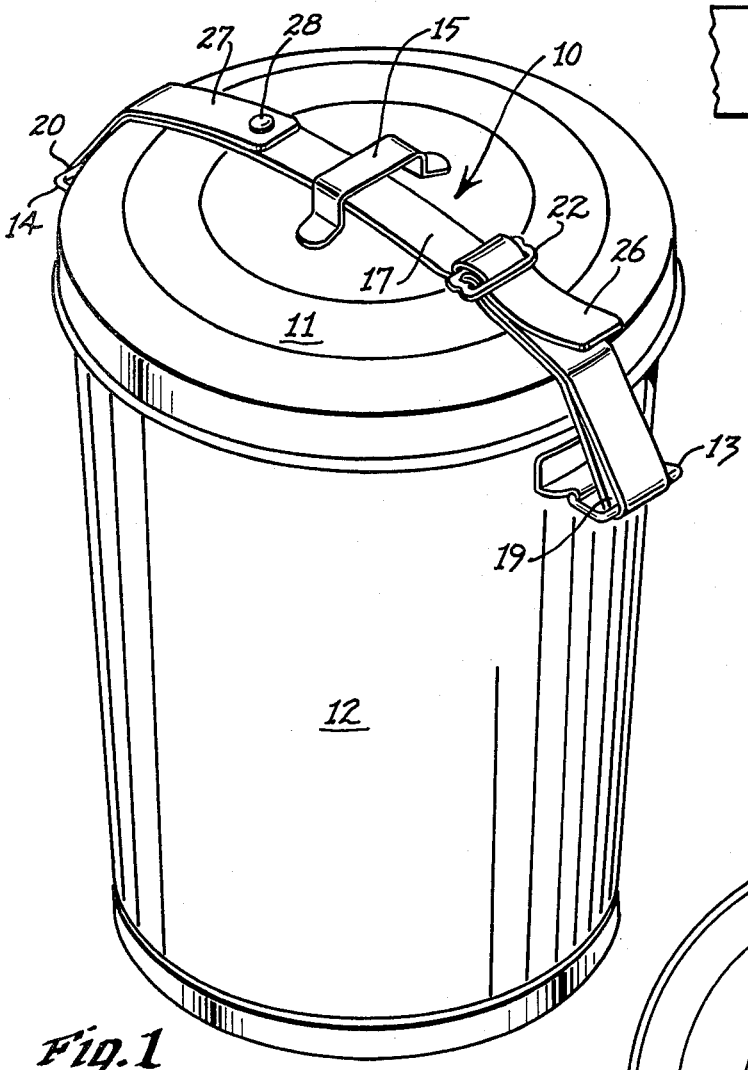
FIG. 1 is a top perspective view of a refuse or garbage can with the lid in closed position, and disclosing the retainer strap in operative position.
Figure 2:
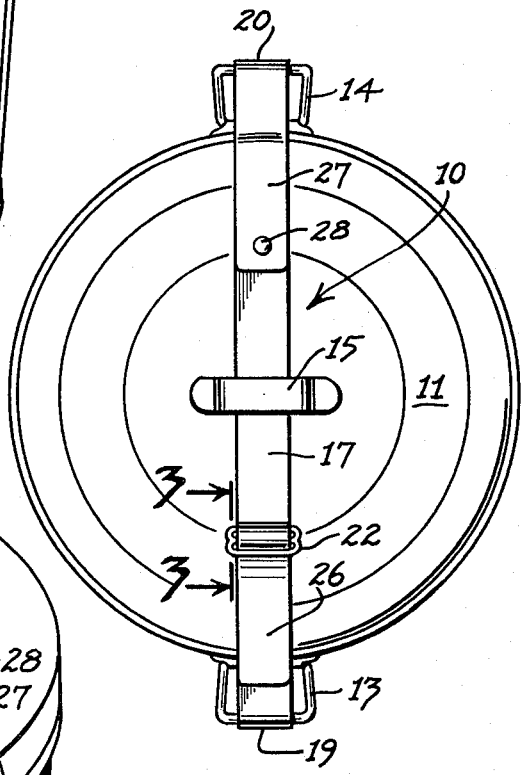
FIG. 2 is a top plan view of the garbage can lid and strap member, disclosed in FIG. 1.

Referring now to the drawings in more detail, FIGS. 1 and 2 disclose a retainer strap 10 made in accordance with this invention for securing the lid 11 in a closed position upon an open-top container, such as a refuse or garbage can lid 12. The container 12 is of a conventional construction having opposed open-loop handles 13 and 14, normally used to lift the container 12. Moreover, the lid 11 disclosed in FIGS. 1 and 2 includes an open-loop top handle 15, of conventional construction, utilized for lifting, holding and lowering the lid 11 relative to the container 12.

The retainer strap 10 includes an elongated flexible strap member 17, preferably of a flexible plastic material which is weather-resistant. The strap member 17 is narrow enough to extend through the open loop of the top handle 15 and also through the open-loop side handles 13 and 14. The length of the strap member 17 is sufficient to extend completely across the lid 17 and through the open-loop side handles 13 and 14, and to be folded back upon itself to form the first and second loops 19 and 20.

Slidably engaging the strap member 17 is a slidable buckle member 22 having a transverse center bar 23 dividing the buckle member 22 into a pair of transversely elongated openings 24 and 25.

Figure 3:
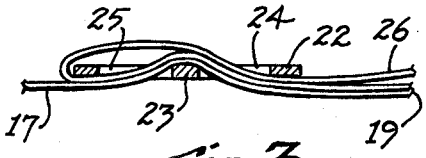
FIG. 3 is an enlarged, fragmentary section, taken along the line 3—3 of the adjustable slide buckle member having cooperative portions of the strap member.

One way of securing the first open loop 19 through and around the open-loop side handle 13 is to thread the first end portion 26 of the strap member 17 through the openings 25 and 24 and over the center bar 23, as illustrated in FIG. 3. The open loop 19 is then formed by folding the first end portion 26 back upon itself and rethreading the first end portion in the reverse direction through the openings 24 and 25 over the bar 23 on top of the previously threaded strap portion 17. Then the first end portion 26 may be secured in position by folding it upward and over the buckle member 22 and down through the opening 24, as illustrated in FIG. 3. In this position, the buckle member 22 may be slidably moved relative to the threaded strap portions in order to enlarge or contract the first open loop 19. Thus, the first loop 19 is more or less permanently secured to the open-loop handle 13, but ia also adjustable.

The second end portion 27 of the strap member 17 is then threaded through the open handle 15 across the lid 11 and inserted through the opposite open-loop side handle 14 and then folded back upon itself to form the second loop 20.

Figure 4:
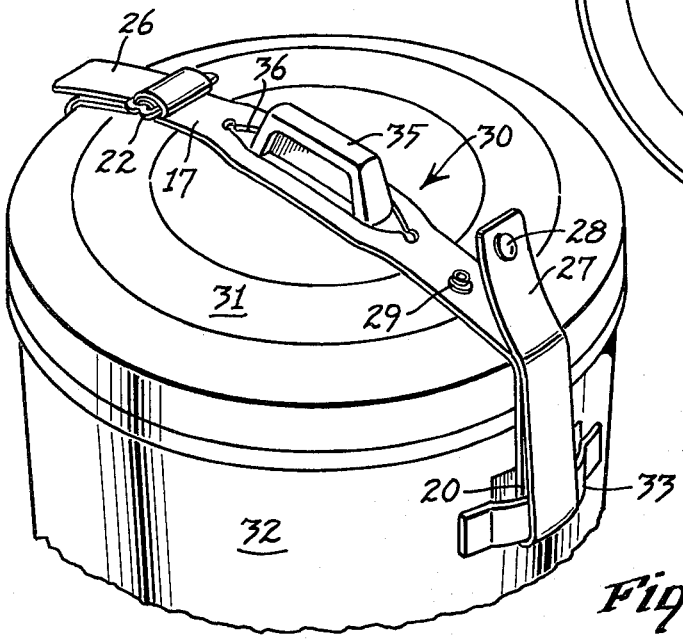
FIG. 4 is a fragmentary, top perspective view of a refuse or garbage can lid having a closed-loop top handle and a strap member modified to accommodate such a handle.

The extremity of the second end strap portion 27 is provided with a first snap fastener element 28, adapted to cooperatively engage a mating snap fastener element 29 (FIG. 4). The snap fastener element 29 is fixed to the strap member 17 at a substantial distance inward from the extreme snap fastener 28 to provide ample room to form the second loop 20.

Thus, although the snap fastener elements 28 and 29 provide a second loop of fixed dimensions, nevertheless the legs of the loop 20 are readily attached in order to quickly assemble the strap member 17 about the side handle 14, and just as easily detached so the lid 11 may be easily removed to open the top of the container 12. In effect, the first loop 19 of the strap member 17 functions as a strap hinge to permit the lid 11 to be raised to introduce refuse into the can 12 and also to discharge the same from the can 12.

After the first end portion of the strap 27 has been threaded through the open-loop side handle 14, folded back upon itself, and secured by the snap fasteners 28 and 29, then the slide buckle 22 may be adjusted to tighten the strap member 17 across the top of the lid 11 to hold the lid firmly in its closed position.

Thus, with the retainer strap 10 secured to the lid 11 in operative position, the lid 11 will be secured in that closed position even if the can 12 is upset or knocked over by a strong wind, by dogs, or by any other force.

Furthermore, it is noted that the retainer strap 10 consists primarily of the flexible plastic member 17. The only hardware elements added to this flexible strap member 17 are the two snap fastener elements 28 and 29 and the slide buckle 22. Accordingly, the retainer strap 10 is economical to manufacture and to use, and can be operated quickly to secure the lid 11 in its closed position over the open top of the container 12, and to release the lid 11.

Furthermore, because of the slide buckle member 22, the retainer strap 10 may be quickly and easily adapted to secure lids of varying sizes in their closed positions over various types of containers 12.

In FIG. 4, the lid 31 closing the container, such as garbage can 32, is provided with a different style of top handle 35 than the open-loop handle 15. The handle 35 is a solid, upward projecting handle with no open loop therethrough so that the strap member 17 can not be inserted through the handle 35. Accordingly, since the handle 35 is an elongated projection, an elongated slit or slot 36 is formed longitudinally in the middle portion of the strap member 17 of the modified retainer strap 30, to fit over the handle 35, as illustrated in FIGS. 4 and 5.

The container 32 in FIG. 4 also has a pair of open-loop handles 33 of slightly different construction than the handles 13 and 14. Nevertheless, the first and second loops 19 and 20 formed in the retainer strap 10 are just as easily extended through, and secured to, the modified side handles 33, as illustrated in FIG. 4.

Figure 5:
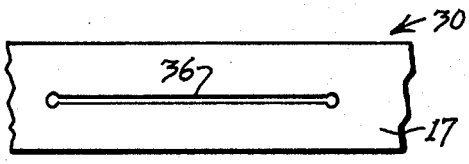
FIG. 5 is an enlarged, fragmentary, top plan view of the middle portion of the strap member disclosed in FIG. 4, illustrating the elongated slot for receiving the top handle.

Of course, the retainer strap 30, disclosed in FIGS. 4 and 5, could also be used to pass through the open-loop handle 15 of the lid 11 in FIG. 1, if desired. Thus, the slot 36 provides more optional uses for the retainer strap 30 for different styles of container lids.

If it is desired to leave the lids 11 or 31 off of their respective containers 12 and 32 for any length of time, such as for example when the container is being cleaned and permitted to dry, the loop 20 may be secured about the open-loop handle 15, thereby securing the lid to the can so that the lid 11 will not become lost.

The width, or the narrow dimensions, of the openings 24 and 25 in the buckle 22 are such as to permit the sliding of the respective strap portions through the corresponding openings 24 and 25, yet permit snug engagement with the buckle member 22, to hold the adjacent strap portions in frictional engagement with each other and the buckle 22 in order to hold the loop 19 in its final adjusted position.

The snap fasteners 28 and 29 as well as the buckle 22 are made of materials which are weather-resistant and non-corrosive.

Furthermore, regardless of which type of retainer strap 10 or 30 is employed, the closed loop 19 will always be secured to the handle 13 or 33 unless there is a positive unthreading of the first end portion 26 from the slide buckle 22. Thus, the retainer straps 10 and 30 will always be secured to their respective cans 12 and 32 without danger of being lost, even though the respective lids 11 and 31 may be entirely removed from their respective containers 12 and 32.

What is claimed is:

1. A retainer device for detachably holding a lid having a top handle in closed position upon an open-top receptacle having a pair of opposed open-loop side handles, comprising:

(a) an elongated flexible strap member having first and second end portions, (b) adjustable securing means on said strap member for holding said first end portion folded back upon itself in different positions to form an adjustable first loop adapted to extend through one of the open-loop side handles of the receptacle, (c) a first fastener member fixed on said strap member adjacent the extremity of said second end portion, (d) a second fastener member manually detachably cooperative with said first fastener member and fixed on said strap member sufficiently spaced from said first fastener member so that the cooperative engagement of said first and second fastener members forms a second loop adapted to extend through and be secured to the other open-loop side handle in operative position, when said strap member extends across the top of the lid in closed position, (e) said first and second fastener members being manually detachable from each other to open said second loop in an inoperative position, and to permit said strap member to be removed from the corresponding open-loop side handle.

2. The invention according to claim 1 in which said adjustable securing means comprises a slide buckle member having openings slidably and snugly receiving portions of said strap member to form said first loop in an operative position and to be slidably removable from the openings in said slide buckle member to open said first loop in an inoperative position for removal of said strap member from the corresponding open-loop side handle.

3. The invention according to claim 1 in which said first and second manually detachable fastener members are cooperative snap fasteners.

4. The invention according to claim 1 in which said strap member is adapted to cooperate with the top handle on the lid when said strap member extends across the top of the lid in closed position.

* * * * *